US005436421A

United States Patent [19]

Sadowski

[11] Patent Number: 5,436,421

[45] Date of Patent: Jul. 25, 1995

[54] PROGRESSIVE SWITCH

[75] Inventor: Walter A. Sadowski, Newington, Conn.

[73] Assignee: Carlingswitch, Inc., Plainville, Conn.

[21] Appl. No.: 226,951

[22] Filed: Apr. 13, 1994

[51] Int. Cl.[6] ..... H01H 21/82

[52] U.S. Cl. ..... 200/558; 200/553

[58] Field of Search ..... 200/558, 559, 557, 553, 200/547, 551, 542, 537, 16 R, 16 B, 16 D, 6 R, 6 C, 1 B

[56] References Cited

U.S. PATENT DOCUMENTS 3,770,921 11/1973 Wilbrecht ..... 200/16 R 5,105,059 4/1992 Sorenson et al. ..... 200/558

*Primary Examiner*—J. Casimer Jacyna
*Assistant Examiner*—David J. Walczak
*Attorney, Agent, or Firm*—McCormick, Paulding & Huber

[57] ABSTRACT

A two pole electrical switch has side-by-side movable contacts operated by a single rocker/actuator of the type having side-by-side pin recesses. Two pins in these recesses are spring biased toward the movable contacts to achieve contact closing, but one pin has its end offset from the other pin end so the closing is sequential rather than simultaneous.

8 Claims, 3 Drawing Sheets

PROGRESSIVE SWITCH

BACKGROUND OF THE INVENTION

This invention relates generally to rocker switches of the type disclosed in prior U.S. Pat. No. 5,105,059. In that patent a rocker switch is disclosed having a unique pivotal support for the rocker and actuator in an improved environmentally protected switch. The disclosure in that prior patent is incorporated by reference herein.

SUMMARY OF THE INVENTION

In accordance with the present invention a progressive switch is provided for sequentially closing at least two contacts provided movably in two side-by-side cavities of the same switch housing. Central fixed terminals extend upwardly into the cavities and define supporting lands for the movable contacts. Fixed contacts are provided in space relationship to these center fixed terminals and the movable contacts have portions adapted to abut these fixed contacts as a result of rocking motion of the switch actuator or rocker. The rocker is pivotably supported in the housing as mentioned previously for motion in one and an opposite direction. The actuator has at least two side-by-side pins slidably received in recesses defined in the actuator for movement on longitudinal axes that are parallel to one another and that define a plane which is perpendicular to the motion of the actuator itself.

Means is provided for biasing these pins so that the pin ends engage the movable contacts, and at least one of the pin ends moves past an associated fixed terminal, or movable contact supporting land portion of the fixed terminal before the other of said pins moves past its associated fixed terminal. As a result of this construction one movable contact closes before the other movable contact closes allowing the. switch to be used or wired as a "progressively closing" switch.

The general purpose of the present invention is to provide a switch housing and associated rocker that are adapted for use in fabricating a switch of the type shown in the above mentioned U.S. Pat. No. 5,105,059, and which switch housing and actuator can also be used to provide a progressive switch in accordance with the present invention. This ability to utilize standard components for different types of switches reduces the inventory required on the part both of manufacturer and the distributor of electrical switches generally. The movable contacts provided in the switch housing are of conventional geometry as too are the fixed terminals and fixed contacts. Only the pins slidably received in the actuator recesses differ in their configuration from the conventional pins provided in the switch as shown in prior U.S. Pat. No. 5,205,059.

BRIEF DESCRIPTION OF THE DRAWINGS

A more complete understanding of the invention and many of its attendant advantages will be readily appreciated as the same become better understood by reference to the following detailed description when considered in conjunction with the accompanying drawings wherein.

DETAILED DESCRIPTION

Figure 1:
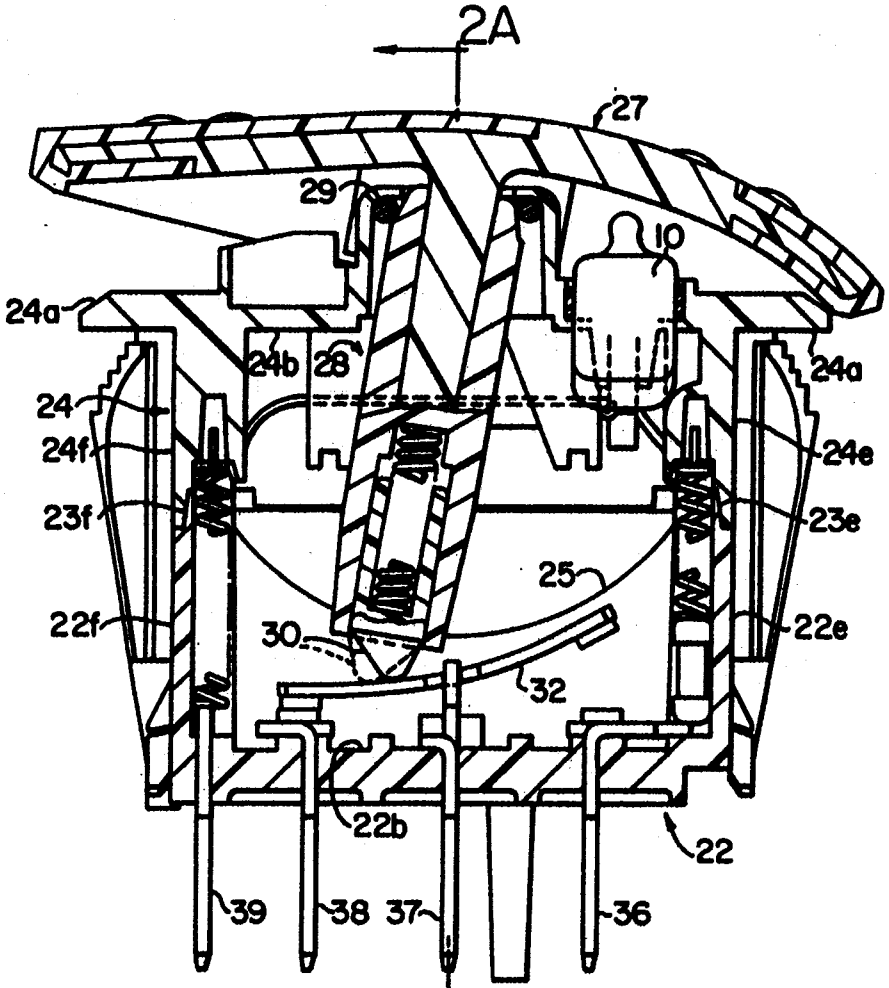
FIG. 1 is a vertical section taken through a switch constructed in accordance with the present invention, the rocker and its associated actuator and the two movable pins being shown in one position.

Turning now to the drawings in greater detail, FIG. 1 shows an electric switch housing means comprising a base 22 having a bottom wall 22*b* in which openings are provided for various fixed terminals such as those illustrated at 36, 37, 38 and 39. The base 22 also includes laterally spaced front and rear walls 22*c* and 22*d* best shown in FIG. 2A. The opposed end walls 22*e* and 22*f* like the front and rear walls 22*c* and 22*d* are integrally connected to one another and to the bottom wall 22*b* so as to define an upwardly open base that is divided into side-by-side cavities by a longitudinally extending divider wall 25. Each such switch case cavity contains associated fixed contacts such as those shown at 36, 37, 38 and 39 with reference to the nearest cavity to the observer in FIGS. 1, 2 and 3. Movable contact 32 is provided in the near of these two cavities while FIG. 2A shows a second movable contact 33 provided in the second cavity which is provided on the opposite side of the divider wall 25.

As in the prior art U.S. Pat. No. 5,105,059, which is incorporated by reference herein a mounting bracket 24 is provided to enclose the upwardly open base 22 and this mounting bracket 24 includes front and rear walls 24*c* and 24*d* which mate with the front and rear walls 22*c* and 22*d* respectively of the base 22 as indicated 23*c* and 23*d* in FIG. 2A. This mounting bracket 24 also includes end walls 24*e* and 24*f* which also mate with the end walls 22*e* and 22*f* respectively of the base as indicated generally at 23*e* and 23*f* in FIGS. 1, 2 and 3. This geometry effectively seals the interior of the switch case from external environmental hazards. Note the O-ring seal 29 provided in the upstanding boss of the mounting bracket which is provided to achieve this result in the area of movement between the rocker/actuator 28/27 relative to the switch case housing defined by the base and the mounting bracket.

Still with reference to the mounting bracket 24 its top wall 24*b* defines a peripherally extending flange 24*a* which is adapted to engage the face of a panel (not shown) the panel defining an opening of suitable rectangular shape and size for receiving the switch case bracket.

Figure 2A:
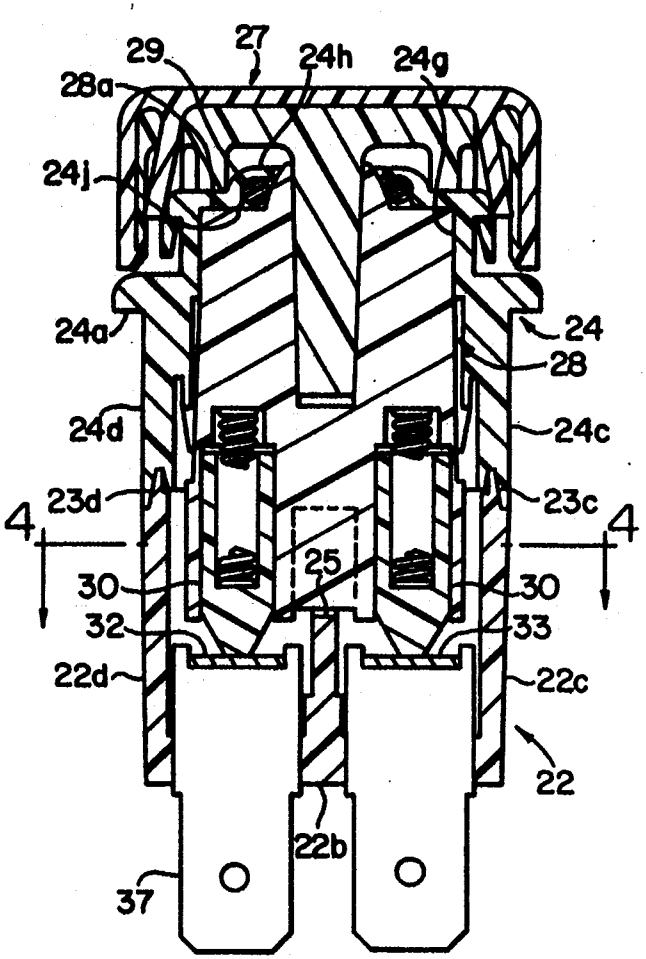
FIG. 2A is a sectional view taken generally on the line 2A—2A of FIG. 1.

With reference to FIG. 2A the mounting bracket 24 includes not only the upstanding boss 24*h* defined centrally of the top wall 24*b* for receiving the rocker/actuator 28/27, but the center portion of this mounting bracket 24 also includes a laterally extending rib 24*g*, actually ribs 24*g* define inner sockets 24*j* that receive shoulder portions 28*a* of the actuator/rocker 28/27.

As so constructed and arranged, and as described in detail in the above mentioned prior U.S. Pat. No. 5,105,059 the rocker/actuator is adapted to move pivotably between limit stops, and generally between the position shown for the rocker/actuator in FIGS. 1 and 3.

Figure 2:
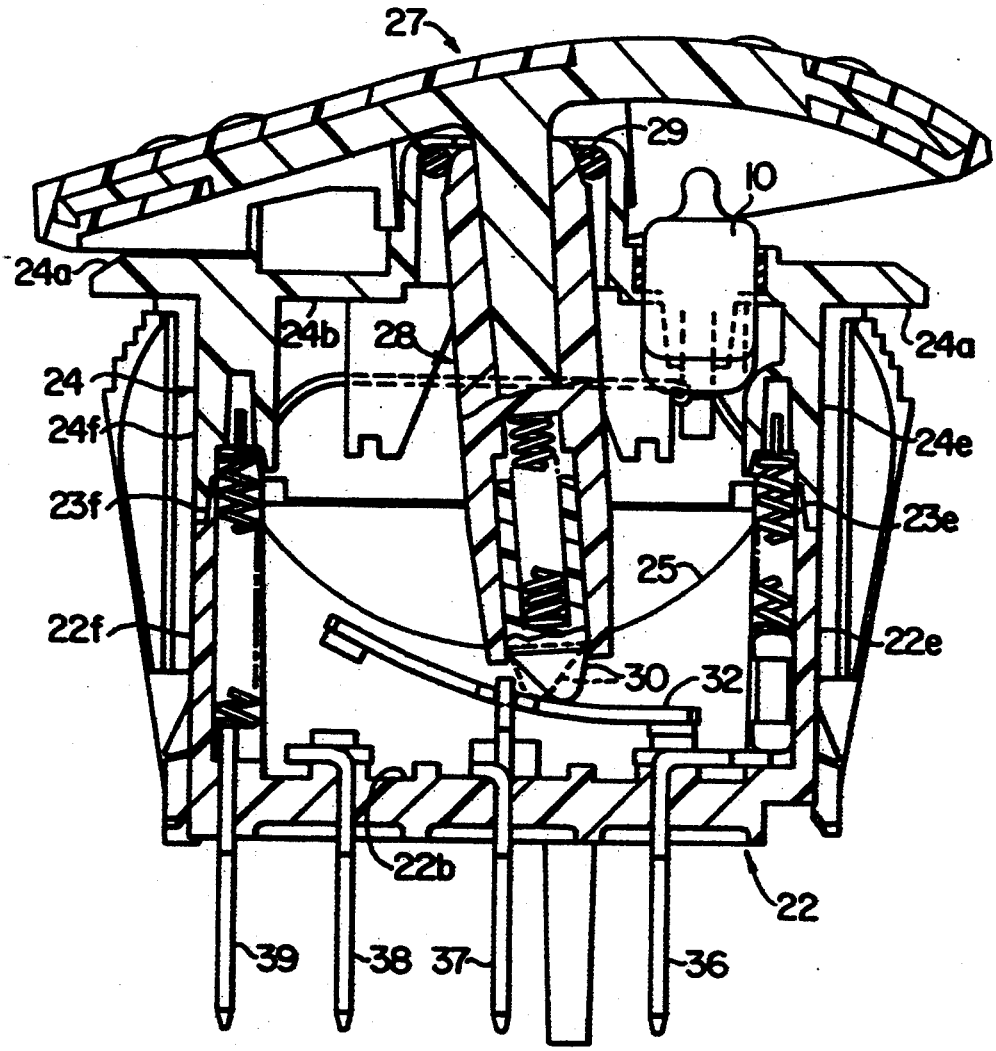
FIG. 2 is a vertical section generally similar to FIG. 1, but illustrating the rocker and actuator in an intermediate position such that one of the movable contacts as shifted from the FIG. 1 position whereas the other movable contact remains in the FIG. 1 position.
Figure 4:
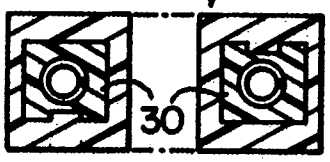
FIG. 4 is a sectional view taken on the line 4—4 of FIG. 2A.
Figure 3:
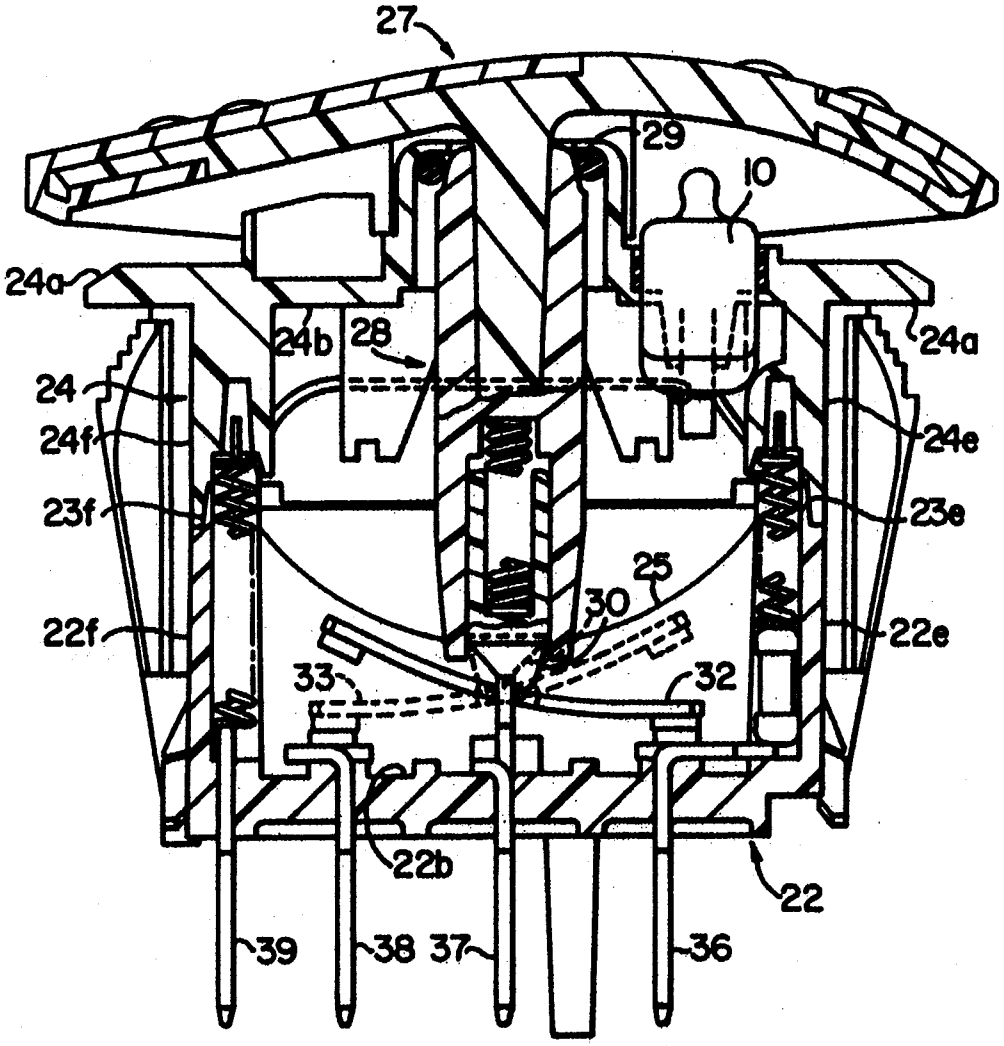
FIG. 3 is a sectional view generally similar to FIGS. 1 and 2, but illustrating the rocker and movable actuator in a position generally opposite that of FIG. 1.

As described hereinabove, the switch of the present invention may be identical to that of the prior U.S. Pat. No. 5,105,059 patent. However, the actuator portion of the rocker/actuator combination is different in the present invention, and as shown in the drawings that actuator portion 28 has downwardly open rectangular recesses for slidably receiving generally rectangular pins 30, 30 which pins have lower ends for engaging the upper concave surface of associated movable contact provided in the side-by-side cavities of the switch base. Each pin is spring biased downwardly to accommodate the pivotal movement of the rocker/actuator to the rocking motion of the movable contact as best shown in FIG. 2. With reference to FIGS. 1, 2 and 3 the lower ends of these pins 30, 30 are offset one from another to provide closing of one movable contact 32 in its associated cavity prior to closing of the other movable contact 33 in the adjacent cavity.

As a result of this unique configuration for the lower ends of the pins 30, 30 a progressive switch is provided with sequential closing of its contacts rather than simultaneous closing of such contacts as might otherwise be expected in a typical double pole switch of the type illustrated here. Consequently, the manufacturer can assemble a progressive switch from otherwise available components such as those normally provided in a typical double pole switch. The only exception to this statement would be the pins themselves. Since the pins have offset lower end portions, to achieve the results described above the pins would have to be assembled with the actuator in opposed relationship one to another with the offset end portions of the pins. In order to assist in the assembly of a progressive switch according to the invention the pins are of identical rectangular cross section with grooves on one side. The actuator recesses are provided with one projection on one side to receive these pins in opposite orientations with respect to one another. Although the pins are identical, the actuator recesses are so formed that each pin is receive in its recess to provide the pin lower ends in offset relationship to one another.

Although the progressive switch described above is embodied in a switch of the type illustrated in prior U.S. Pat. No. 5,105,059 it will be apparent that the invention is equally adapted to double pole switches of different geometry. More particularly, the two part housing is not an essential part of the invention and the advantages of the present invention might also be realized in a one-piece molded housing with an upwardly open cavity for itself receiving a switch actuator such as a rocker. It is important that the invention be embodied in a double pole switch, however, and at least two side-by-side cavities are required to realize the advantages of the present invention. So too, the presence of a light source 10 in a switch of the present invention is an added feature that is not essential to the realization of the advantages of the present invention. It will be apparent that the use of a lamp 10 in the mounting bracket 24 of the switch case shown can be an added feature for a switch incorporating the present invention.

In the switch shown, FIGS. 1 and 3 show stable limit positions for the rocker/actuator 28/27. It will be apparent, however, that other movable contact configurations might be used in a switch according to the present invention. For example, the movable contact 32 might be replaced by a more steeply contoured movable contact of the type utilized in momentary switches. See for example the movable contact illustrated in FIG. 7 of the above mentioned prior U.S. Pat. No. 5,105,059. In such momentary switch configurations the movable contact is steeply sloped so as to cause the rocker/actuator to return to one or the other of the two positions shown for it in FIGS. 1 and 3.

It will also be apparent that the ON/ON switch configuration shown in the enclosed drawings might instead be replaced by an ON/OFF terminal configuration where the movable contact or contacts 32 and 33 are actually OFF in one or the other of the two positions shown in FIGS. 1 and 3. Although the switch shown is an ON/ON type switch, the invention can also be realized in a switch of the ON/OFF variety.

As shown in the drawings the movable contacts 32 and 33 are pivotably supported at the upper ends of center fixed terminals such as shown at 37. In a center OFF switch of the three position type the center terminal is provided with a bifurcated upper end portion for supporting the movable contact in a mid-position where the rocker/actuator will also be midway between its two limit positions. The present invention might also be realized in a three position switch characterized by such a center OFF position for the movable contact and the following claims are intended to cover this and the previously described variations of electrical switch.

I claim:

1. A progressive switch for sequentially closing electrical contacts, said switch comprising:

housing means defining at least two side-by-side cavities, at least two fixed terminals, each terminal having an end portion defining a movable contact support land, movable contacts provided on said movable contact supporting lands for rocking motion thereon, fixed contacts provided in said switch case cavities and spaced from said movable contact supporting lands, said movable contacts having portions adapted to abut said fixed contacts as a result of said rocking motion at least in one direction, an actuator pivotably supported in said housing means for motion in one and an opposite direction, said actuator having at least two pins provided in side-by-side recesses defined in said actuator, said pins having portions slidably received in said side-by-side recesses and means biasing said pins against said movable contacts, said pins having ends causing said rocking motion of said movable contacts, one of said pins moving past an associated fixed terminal before the other of said pins moves past its associated fixed terminal whereby said one movable contact closes with its associated fixed contact prior to the closing of the other movable contact with respect to its associated fixed contact, said movable contact lands being laterally aligned with respect to one another in said side-by-side cavities.

2. The switch according to claim 1 wherein said pins have a non-cylindrical contour, and wherein said pins are slidably received in non-circular recesses of said actuator.

3. The switch according to claim 1 wherein said movable contacts have mid-portions pivotably received on said lands of said fixed terminals, and wherein said movable contacts have top surfaces engaged by said pin ends, said movable contact top surfaces being of identical concave contour with respect to one another.

4. The switch according to claim 3 wherein at least one of said pin ends is offset in the direction of said rocking motion of said actuator from the other pin end to achieve sequential closing of said fixed contacts.

5. The combination according to claim 3 wherein said pins are of generally rectangular cross section, and wherein said pins have tapered end portions, one end of one of said at least two pins being on one side of an associated longitudinal axis of said one pin, and the other of said at least two pins having its associated pin end on an opposite side of a longitudinal axis of said other pin, said pin axes being parallel to one another and defining a plane generally perpendicular to the direction of said actuator motion.

6. The switch according to claim 5 wherein said actuator motion is pivotable on an axis oriented perpendicular said pin longitudinal axes, said axis of actuator motion provided in the same general plane with said longitudinal pin axes.

7. The switch according to claim 6 wherein said rectangular pins are of square cross section, and wherein said actuator defined pin recesses are of complementary cross section to slidably receive said pins.

8. The switch according to claim 7 wherein said rectangular pins have one side defining a groove parallel said pin axis, and said actuator recesses defining projections on opposite sides of said rectangular pin recesses to receive said pins in oppositely arranged positions, said pins being of identical geometry and said pin recess projections serving to orient said pins for said sequential contact to closing.

* * * * *